US011111640B2

(12) United States Patent
Frank et al.

(10) Patent No.: US 11,111,640 B2
(45) Date of Patent: Sep. 7, 2021

(54) SELF-PROPELLED CONSTRUCTION MACHINE

(71) Applicant: Wirtgen GmbH, Windhagen (DE)

(72) Inventors: Burkhard Frank, Vettelschoß (DE); Markus Schäfer, Asbach / Hussen (DE)

(73) Assignee: Wirtgen GmbH

( * ) Notice: Subject to any disclaimer, the term of this patent is extended or adjusted under 35 U.S.C. 154(b) by 0 days.

(21) Appl. No.: 17/009,510

(22) Filed: Sep. 1, 2020

(65) Prior Publication Data

US 2021/0108379 A1 Apr. 15, 2021

(30) Foreign Application Priority Data

Oct. 15, 2019 (DE) ..... 10 2019 127 745.0

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E02F 9/2203; E02F 3/844; E02F 9/028; E02F 9/22; E02F 9/2264; E02F 9/2267;
(Continued)

(56) References Cited

U.S. PATENT DOCUMENTS 8,424,972 B2 4/2013 Berning et al.
2009/0108663 A1* 4/2009 Berning ..... E01C 23/088 299/1.5

(Continued)

FOREIGN PATENT DOCUMENTS

DE 102012015346 A1 2/2014
DE 102012012397 A1 4/2014
EP 2650443 A2 10/2013

OTHER PUBLICATIONS

European Search Report for corresponding EP 20 19 4560, dated Feb. 15, 2021, 6 pages (not prior art).

*Primary Examiner* — Janine M Kreck
*Assistant Examiner* — Michael A Goodwin
(74) *Attorney, Agent, or Firm* — Lucian Wayne Beavers; Patterson Intellectual Property Law, PC

(57) ABSTRACT

The self-propelled construction machine according to the invention, in particular a road milling machine, stabiliser, recycler or surface miner, has a machine frame 1, a work roller arranged on the machine frame, and a left-hand edge protector 5A arranged on the left-hand side of the work roller in the working direction and a right-hand edge protector 5B arranged on the right-hand side of the work roller in the working direction. In order to raise and/or lower the left-hand and/or right-hand edge protector 5A, 5B, a hydraulic system is provided which comprises a hydraulic source 20 for providing hydraulic fluid. The hydraulic system is characterised in that only a single main directional control valve 13 which has three switch positions and is associated with a first and a second hydraulic cylinder 6A, 6B is provided, which main directional control valve interacts with a first auxiliary directional control valve 14 which has two switch positions and is associated with the first hydraulic cylinder 6A, and with a second auxiliary directional control valve 15 which has two switch positions and is associated with the second hydraulic cylinder 6B, in order to be able to raise and/or lower or floatingly mount the edge protectors.

18 Claims, 9 Drawing Sheets

(58) Field of Classification Search
CPC ..... E02F 9/2278; E02F 9/2282; E02F 9/2289; E02F 9/2292; E02F 9/2296; E01C 23/088; E01C 23/127
See application file for complete search history.

(56) References Cited

U.S. PATENT DOCUMENTS

| | | | | |
|---|---|---|---|---|
| 2011/0163511 | A1* | 7/2011 | Berning | B60G 17/056 280/6.157 |
| 2013/0257136 | A1* | 10/2013 | Held | E01C 23/127 299/10 |
| 2014/0035343 | A1 | 2/2014 | Berning et al. | |
| 2015/0197901 | A1* | 7/2015 | Franzmann | E01C 23/088 299/1.5 |
| 2016/0160455 | A1* | 6/2016 | Vogt | E01C 23/088 299/1.5 |
| 2016/0186391 | A1* | 6/2016 | Wachsmann | E01C 23/088 299/1.5 |
| 2019/0203430 | A1* | 7/2019 | Wachsmann | E01C 23/127 |

* cited by examiner

| | A | B | C | D | E |
|---|---|---|---|---|---|
| S | | | | X | X |
| ↑L | X | X | | X | |
| ↓L | X | | X | X | |
| ↑R | X | X | | | X |
| ↓R | X | | X | | X |
| ↑L+R | X | X | | X | X |
| ↓L+R | X | | X | X | X |

Fig. 4B

| | A | B | C | D | E |
|---|---|---|---|---|---|
| S | | | | X | X |
| ↑L | X | X | | | X |
| ↓L | X | | X | X | |
| ↑R | X | X | | X | |
| ↓R | X | | X | | X |
| ↑L+R | X | X | | | |
| ↓L+R | X | | X | X | X |

Fig. 5B

| | A | B | C | D | E |
|---|---|---|---|---|---|
| S | | | | X | X |
| ↑L | X | X | | | X |
| ↓L | X | | X | X | |
| ↑R | X | X | | X | |
| ↓R | X | | X | | X |
| ↑L+R | X | X | | | |
| ↓L+R | X | | X | X | X |

Fig. 6B

SELF-PROPELLED CONSTRUCTION MACHINE

CROSS REFERENCES TO RELATED APPLICATIONS

This application claims priority to German patent application number 10 2019 127 745.0 filed Oct. 15, 2019, which is hereby incorporated by reference.

BACKGROUND OF THE INVENTION

1. Field of the Invention

The invention relates to a self-propelled construction machine, in particular a road milling machine, stabiliser, recycler or surface miner.

2. Description of the Prior Art

The aforementioned self-propelled construction machines have a rotating work roller which can be a milling or cutting drum. By means of the work roller, damaged road layers can be removed, existing road surfaces can be reprocessed, the ground can be prepared for road construction or mineral resources can be mined, for example.

The work roller of known construction machines is arranged in a roller housing which is open at the bottom and which is closed by a hold-down means arranged in front of the work roller in the working direction and by a scraper arranged behind the roller in the working direction. The roller housing is closed on the sides by planar shields which extend in the working direction and are referred to as edge protectors.

The edge protectors of the known construction machines can be adjusted in height. A hydraulic system is provided in order to raise and/or lower the edge protectors. While the construction machine is in operation, the edge protectors stand by having the lower edge thereof on the ground surface to be processed. The edge protectors thereby exert a contact pressure on the ground surface. As the construction machine advances, the edge protectors automatically follow the course of the surface of the ground, with the edge protectors being raised and/or lowered, and this is also referred to as a floating mounting or floating position.

Hydraulic systems for raising and/or lowering the edge protectors are part of the prior art. The known hydraulic systems consist of a large number of components.

SUMMARY OF THE INVENTION

The problem addressed by the invention is that of providing a self-propelled construction machine, in particular a road milling machine, stabiliser, recycler or surface miner, which has a relatively simple and reliable hydraulic system for raising and/or lowering the edge protectors, which system allows the edge protectors to be floatingly mounted.

This problem is solved, according to the invention, by the features of the independent claims. The subject matter of the dependent claims relates to preferred embodiments of the invention.

The self-propelled construction machine according to the invention, in particular a road milling machine, stabiliser, recycler or surface miner, has a machine frame, a work roller arranged on the machine frame for processing the ground material, and a left-hand edge protector arranged on the left-hand side of the work roller in the working direction and a right-hand edge protector arranged on the right-hand side of the work roller in the working direction. In order to raise and/or lower the left-hand and right-hand edge protectors, a hydraulic system is provided which comprises a hydraulic source for providing hydraulic fluid.

The hydraulic system is designed such that the hydraulic source can be brought into fluid connection with one of the two cylinder chambers of a first double-acting hydraulic cylinder for raising and/or lowering the left-hand edge protector and with one of the two cylinder chambers of a second double-acting hydraulic cylinder for raising and/or lowering the right-hand edge protector, such that the left-hand and right-hand edge protectors can be raised and/or lowered. Two hydraulic cylinders that are connected in parallel can also act as a double-acting hydraulic cylinder. In the case of two hydraulic cylinders connected in parallel, the hydraulic source is brought into fluid connection with the cylinder chamber of one and the other cylinder.

The hydraulic system for raising and lowering the edge protectors is characterised in that only a single main directional control valve which has three switch positions and is associated with the first and second hydraulic cylinders is provided, which main directional control valve interacts with a first auxiliary directional control valve which has two switch positions and is associated with the first hydraulic cylinder, and with a second auxiliary directional control valve which has two switch positions and is associated with the second hydraulic cylinder, in order to be able to raise and/or lower or floatingly mount the edge protectors. The hydraulic system therefore has a simple and compact structure.

The hydraulic system for raising and lowering the edge protectors can also be part of a hydraulic system which can also assume other functions in addition to raising and lowering the edge protectors. In this case, the hydraulic system also comprises other components which have a different function to moving the edge protectors.

By means of the main directional control valve, it is possible to predefine, in one of the two switch positions of the first or second auxiliary directional control valve, whether one or the other cylinder chamber of the first or second hydraulic cylinder is supplied with hydraulic fluid in order to be able to raise and/or lower the relevant edge protector. Whether the left-hand edge protector or the right-hand edge protector is raised or the left-hand and right-hand edge protectors are raised is dependent on the switch position of the auxiliary directional control valves. In order to floatingly mount the edge protectors, in one of the two switch positions of the first or second auxiliary directional control valve, a fluid connection between the two cylinder chambers of the hydraulic cylinders can also be predefined by means of the main directional control valve, with the two cylinder chambers of the hydraulic cylinders in turn being in fluid connection with the tank.

The hydraulic system is designed such that, in a first switch position of the main valve and in one of the two switch positions of the first and second auxiliary directional control valves, hydraulic fluid can be supplied to one of the two cylinder chambers of the two hydraulic cylinders, and, in a second switch position of the main valve and in one of the two switch positions of the first and second auxiliary directional control valves, hydraulic fluid can be supplied to the other of the two cylinder chambers of the two hydraulic cylinders, such that the left-hand and/or right-hand edge protector can be raised or lowered, and, in a third switch position of the main directional control valve and in one of the two switch positions of the first and second auxiliary directional control valves, a fluid connection between the two cylinder chambers of the first hydraulic cylinder and the tank and a fluid connection between the two cylinder chambers of the second hydraulic cylinder and the tank can be established, such that the left-hand and right-hand edge protectors can assume a floating position.

Since only one main directional control valve is provided which is associated with the two hydraulic cylinders, the hydraulic system according to the invention has a relatively simple structure. The smaller number of directional control valves also requires fewer hydraulic lines and control lines for actuating the valves, which reduces the overall manufacturing costs. In addition, the smaller number of directional control valves reduces the risk of a directional control valve failing due to a technical malfunction, which increases the reliability of the hydraulic system. Furthermore, the technical effort required to actuate the valves, for example the number of electrical control lines, solenoids, etc., is reduced.

The invention provides different embodiments which, however, only have one main directional control valve which is associated with the two hydraulic cylinders. In all embodiments, the main directional control valve can be a 4-port/3-position directional control valve which is preloaded into the central position and has an inlet port for supplying hydraulic fluid from the hydraulic source, an outlet port for discharging hydraulic fluid to the tank, a first work port and a second work port. In the central position, the inlet port is blocked and the first and second work ports are connected to the outlet port. In the first end position, the inlet port is connected to the second work port and the outlet port is connected to the first work port, and, in the second end position, the inlet port is connected to the first work port and the outlet port is connected to the second work port. This makes a flow reversal possible, and therefore one or the other cylinder chamber can be pressurised.

In a first embodiment, the auxiliary directional control valves are 2-port/2-position directional control valves which are preloaded into one of the two switch positions and have a first work port and a second work port, the first work port and the second work port being blocked in the first switch position, and the first work port and the second work port being interconnected in the second switch position.

In this embodiment, the first work port of the main directional control valve can be fluidically connected to one of the two cylinder chambers of the first and second hydraulic cylinders, the second work port of the main directional control valve can be fluidically connected to the first work port of the first auxiliary valve and to the first work port of the second auxiliary valve, and the second work port of the first auxiliary directional control valve can be fluidically connected to the other of the two cylinder chambers of the first hydraulic cylinder and the second work port of the second auxiliary directional control valve can be fluidically connected to the other of the two cylinder chambers of the second hydraulic cylinder. The auxiliary directional control valves are preferably seat valves that do not have any leakage, and therefore the edge protectors cannot be inadvertently lowered out of an upper locking position as a result of leakage.

In a second embodiment, the auxiliary directional control valves are 4-port/2-position directional control valves which are preloaded into one of the two switch positions and have a first work port, a second work port, a third work port and a fourth work port. In the first switch position, the first work port and the third work port are interconnected and the second work port and the fourth work port are interconnected, and, in the second switch position, the first work port and the fourth work port are interconnected and the second work port and the third work port are interconnected.

In this embodiment, the first work port of the main directional control valve can be fluidically connected to one of the two cylinder chambers of the first and second hydraulic cylinders, the second work port of the main directional control valve can be fluidically connected to the first work port of the first auxiliary valve, a first non-return valve being provided in the flow path, which first non-return valve is open in the direction of the first auxiliary valve, and the second work port of the main directional control valve can be fluidically connected to the first work port of the second auxiliary valve, a second non-return valve being provided in the flow path, which second non-return valve is open in the direction of the second auxiliary valve. The second work port of the first and second auxiliary directional control valves is fluidically connected to the outlet port of the main directional control valve, and the third work port of the first auxiliary directional control valve is fluidically connected to the other of the two cylinder chambers of the first hydraulic cylinder and the third work port of the second auxiliary directional control valve is fluidically connected to the other of the two cylinder chambers of the second hydraulic cylinder. The fourth work port of the first auxiliary directional control valve and the fourth work port of the second auxiliary directional control valve are blocked.

In a third embodiment, the auxiliary directional control valves are 3-port/2-position directional control valves which are preloaded into one of the two switch positions and have a first work port, a second work port and a third work port, the first work port and the third work port being interconnected and the second work port being blocked in the first switch position, and the first work port being blocked and the second work port and the third work port being interconnected in the second switch position.

In this embodiment, the first work port of the main directional control valve can be fluidically connected to one of the two cylinder chambers of the first and second hydraulic cylinders and the second work port of the main directional control valve can be fluidically connected to the first work port of the first auxiliary valve, a first non-return valve being provided in the flow path, which first non-return valve is open in the direction of the first auxiliary valve, and the second work port of the main directional control valve can be fluidically connected to the first work port of the second auxiliary valve, a second non-return valve being provided in the flow path, which second non-return valve is open in the direction of the second auxiliary valve.

The second work port of the first and second auxiliary directional control valves is fluidically connected to the outlet port of the main directional control valve, and the third work port of the first auxiliary directional control valve is fluidically connected to the other of the two cylinder chambers of the first hydraulic cylinder and the third work port of the second auxiliary directional control valve is fluidically connected to the other of the two cylinder chambers of the second hydraulic cylinder.

The main directional control valve and the auxiliary directional control valves can be electromagnetically actuated directional control valves, it being possible to provide a control device for actuating the main directional control valve and the auxiliary directional control valves. This control device can be part of the central control unit of the construction machine, which unit can also undertake other control tasks.

The hydraulic source can comprise a hydraulic pump which has a suction port and a pressure port, it being possible for the suction port to be fluidically connected to a hydraulic fluid tank and for the pressure port to be fluidically connected to the inlet port of the main directional control valve.

In a further embodiment, a flow path is provided between the pressure port of the hydraulic pump and the hydraulic fluid tank, in which flow path a pressure sequence valve is provided. When the pressure sequence valve is open, the hydraulic fluid cannot flow to the inlet port of the main directional control valve, but instead flows into the tank, and therefore the edge protectors can assume a floating position when the two hydraulic chambers of the relevant hydraulic cylinder are fluidically connected. Raising and/or lowering the edge protectors requires the pressure sequence valve to be closed. The pressure sequence valve can be coupled to the ignition of the internal combustion engine of the construction machine such that the first and second edge protectors initially assume a floating position after ignition. The pressure sequence valve can be an electromagnetically actuated 2-port/2-position directional control valve which has a first work port and a second work port, the pressure sequence valve being preloaded into a switch position in which the first and second work ports are interconnected.

In order to limit the pressure, further pressure-limiting valves can be provided in order to open a flow path between the inlet port of the main directional control valve and the hydraulic fluid tank or a flow path between the third work port of the main directional control valve and the hydraulic fluid tank when a predetermined excess pressure is exceeded.

Several embodiments of the invention will be explained in greater detail below with reference to the figures.

BRIEF DESCRIPTION OF THE DRAWINGS

In the figures:

FIG. 4B is a table illustrating the function of the hydraulic system from FIG. 4A, FIG. 5B is a table illustrating the function of the hydraulic system from FIG. 5A, FIG. 6B is a table illustrating the function of the hydraulic system from FIG. 6A.

DETAILED DESCRIPTION

Figure 1:
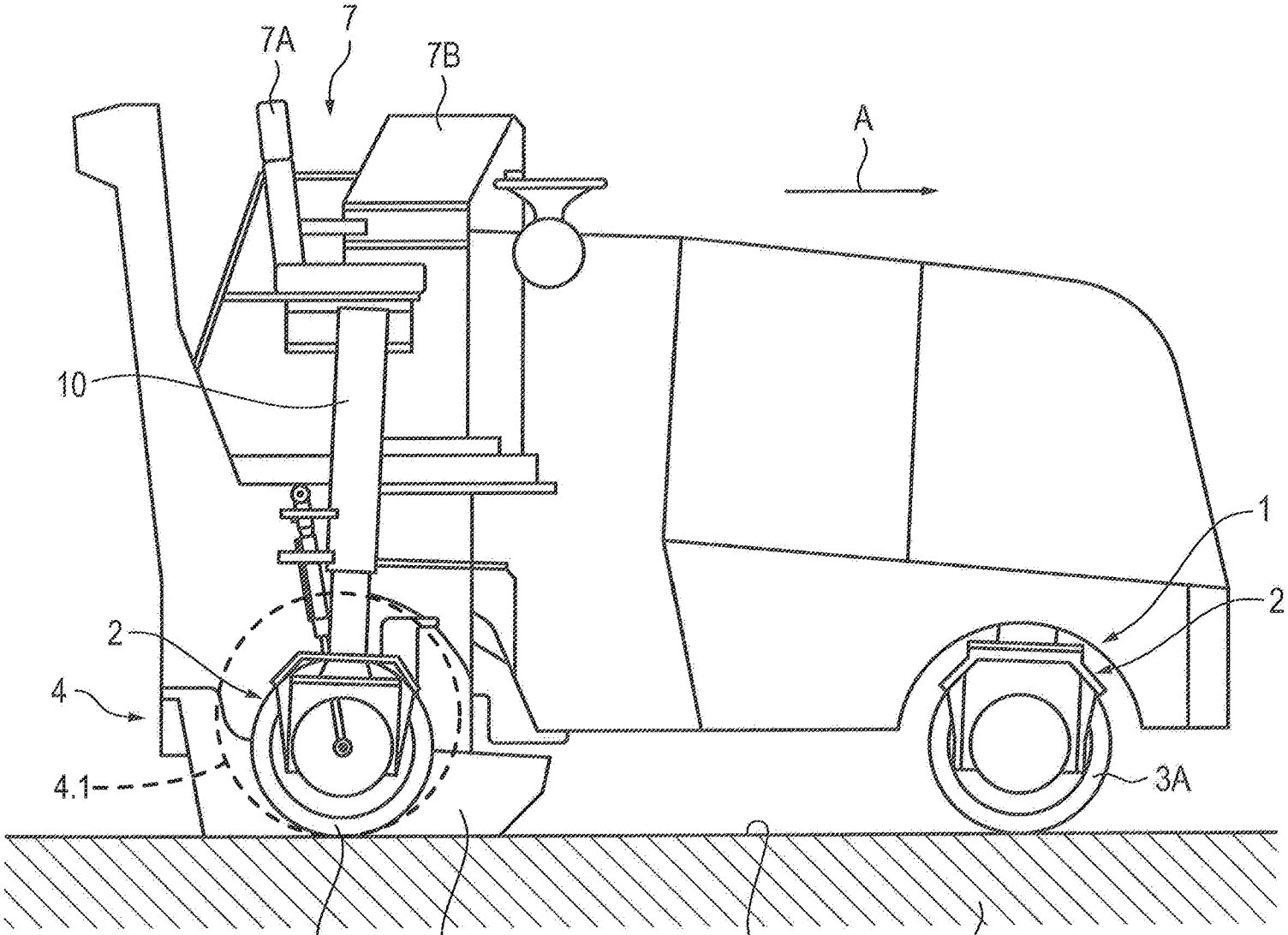
FIG. 1 is a lateral view of a self-propelled construction machine comprising an edge protector.

FIG. 1 is a lateral view of a road milling machine as an example of a self-propelled construction machine. The road milling machine is a small milling machine. The construction machine has a machine frame 1 which is supported by a chassis 2. The chassis 2 has a front wheel 3A and two rear wheels 3B. In FIG. 1, only the rear wheel 3B which is on the right in the working direction A can be seen. In known construction machines, the chassis can also have crawler tracks instead of wheels.

Figure 2:
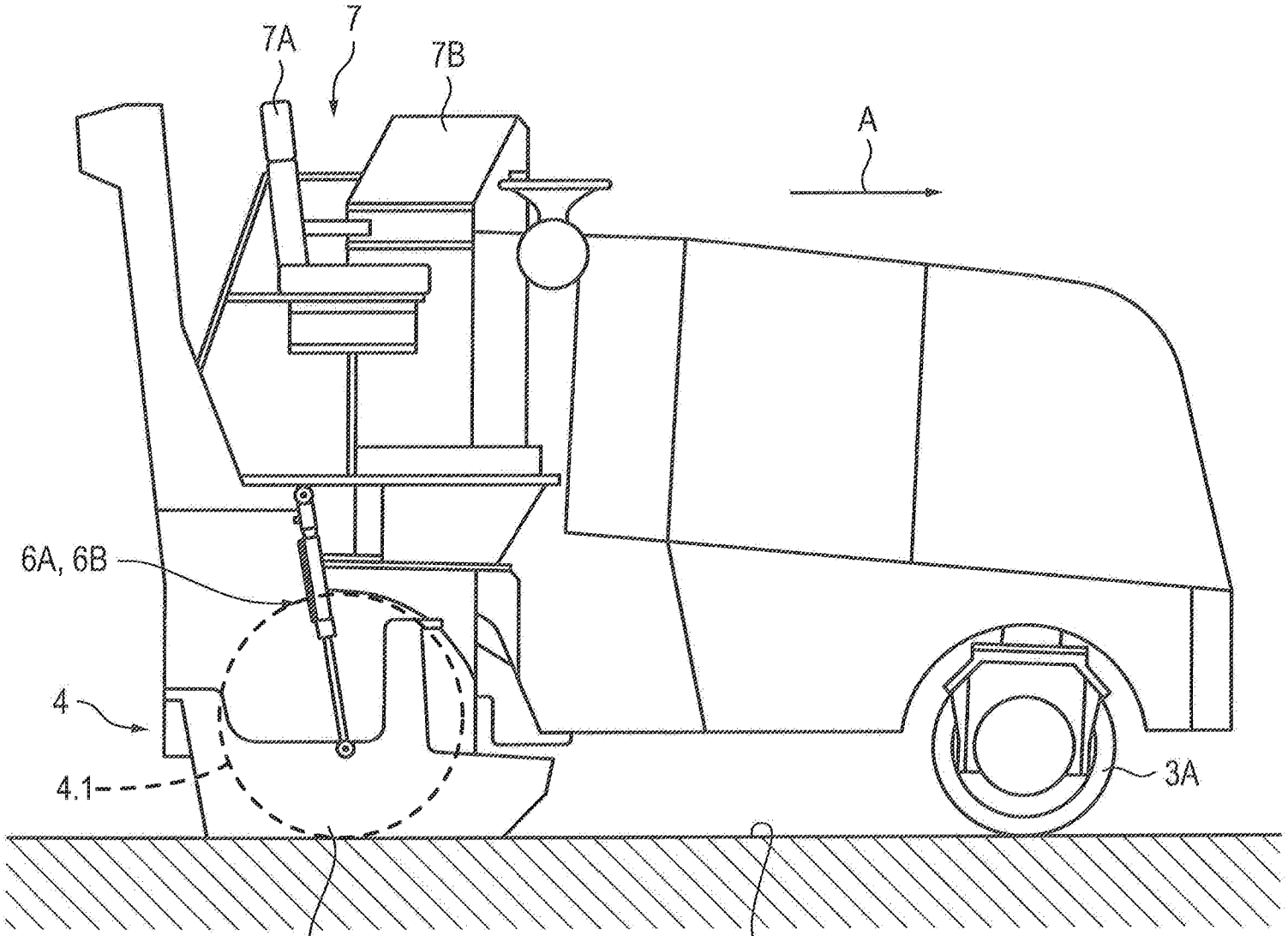
FIG. 2 shows the construction machine from FIG. 1, with the edge protector exposed.

The construction machine has a work roller which is a milling drum. The milling drum 4.1 shown schematically in dashed lines in FIG. 1, is arranged in a milling drum housing 4. The milling drum housing 4 is closed by an edge protector on each of the left-hand and right-hand sides in the working direction A. In FIG. 1, only the edge protector 5B which is on the right in the working direction A can be seen. The driver platform 7 comprising the driver's seat 7A and the control panel 7B is located above the milling drum housing 4. The machine frame 1 of the construction machine can be adjusted in height relative to the surface 11 of the ground 12 on lifting columns 10. FIG. 2 is a view of the construction machine, with the rear right-hand wheel 3B and the rear right-hand lifting column 10 not being shown, so that the right-hand edge protector 5B is exposed.

Figure 3:
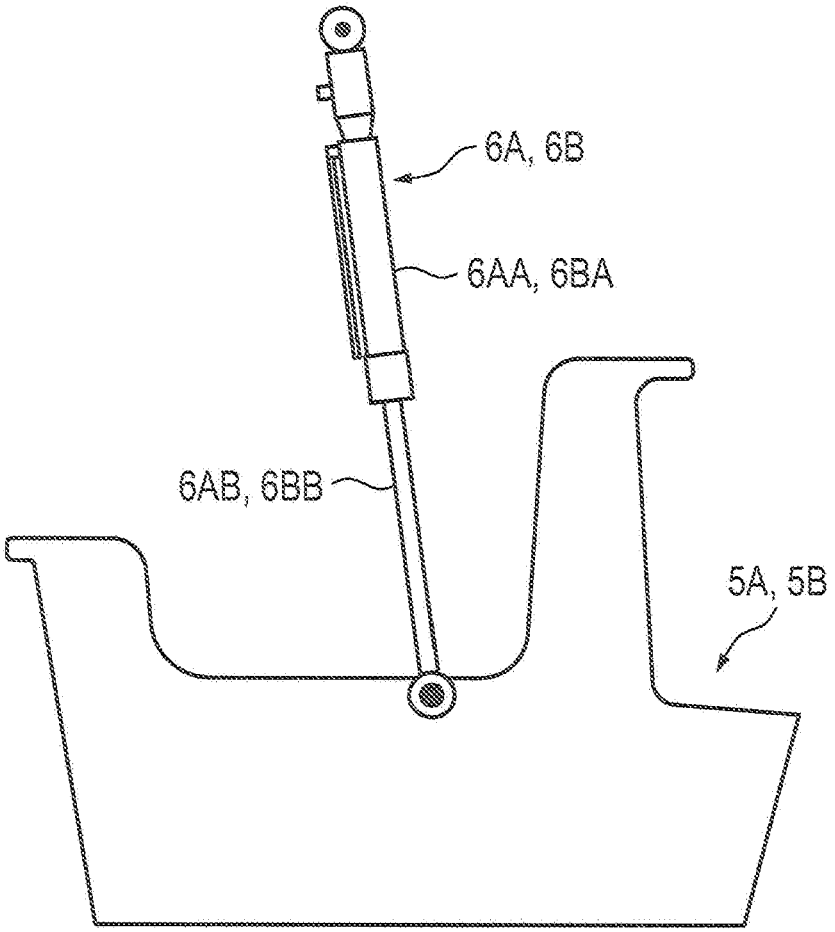
FIG. 3 shows the hydraulic cylinder for raising and/or lowering the edge protector from FIG. 1.

The left-hand and right-hand edge protectors 5A and 5B, which have the same structure, are formed by a metal plate which extends in the working direction A (FIG. 3). The edge protectors can be adjusted in height relative to the ground surface 11 between stops (not shown). The edge protectors 5A, 5B are in this case mounted between the stops so as to oscillate slightly. The height of the edge protectors is adjusted using a hydraulic system which has a first double-acting hydraulic cylinder 6A for the left-hand edge protector 5A and a second double-acting hydraulic cylinder 6B for the right-hand edge protector 5B, the cylinders 6AA, 6BA of which are hingedly mounted on the machine frame 1 and the pistons 6AB, 6BB of which are hingedly mounted on the edge protectors 5A, 5B. The relevant edge protector 5A or 5B can be raised or lowered by retracting and extending the piston of the relevant hydraulic cylinder. The left-hand and right-hand edge protectors 5A and 5B may also be referred to as left-hand and right-hand side-plates 5A and 5B.

In the hydraulic system for raising and/or lowering the edge protectors 5A, 5B, the edge protectors are floatingly mounted, in which mounting the edge protectors 5A, 5B are pulled over the ground as the construction machine advances. In this case, the edge protectors 5A, 5B lie on the ground surface 11 with a defined contact force which can correspond to the weight of the edge protectors or can be greater or smaller than the weight.

The hydraulic system for raising and/or lowering the edge protectors 5A, 5B is described in detail below with reference to the figures.

Figure 4A:
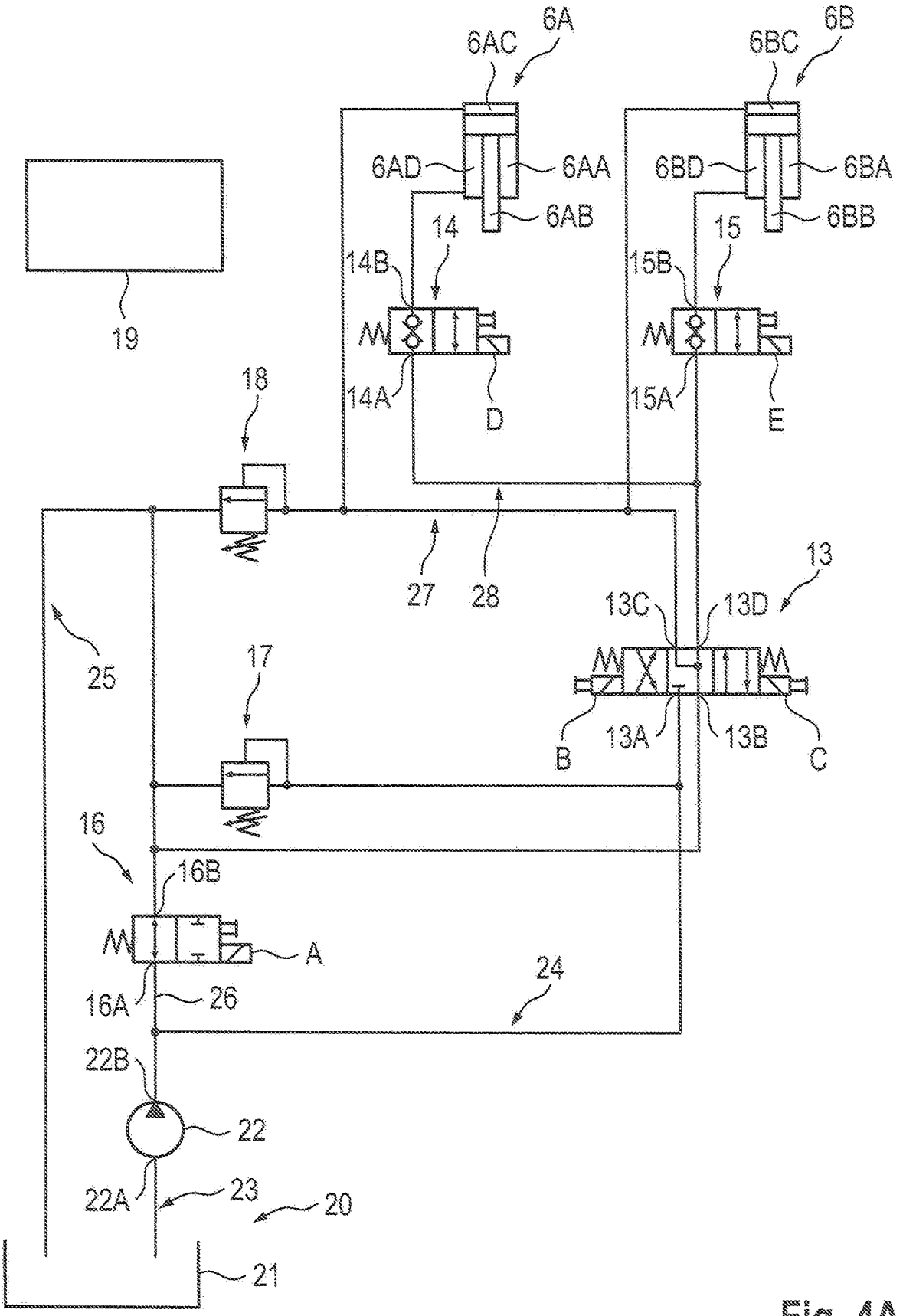
FIG. 4A shows the hydraulic circuit diagram of a first embodiment of the hydraulic system for raising and/or lowering the edge protectors of the construction machine from FIG. 1.

FIG. 4A shows the hydraulic circuit diagram of a first embodiment of the hydraulic system which has a first double-acting hydraulic cylinder 6A for raising and/or lowering the left-hand edge protector 5A and a second double-acting hydraulic cylinder 6B for raising and/or lowering the right-hand edge protector 5B. Furthermore, the hydraulic system has a main directional control valve 13 associated with the first and second hydraulic cylinders 6A, 6B, a first auxiliary directional control valve 14 associated with the first hydraulic cylinder 6A, and a second auxiliary directional control valve 15 associated with the second hydraulic cylinder 6B. In addition, the hydraulic system has a pressure sequence valve 16, a first pressure-limiting valve 17 and a second pressure-limiting valve 18.

The main directional control valve 13, the two auxiliary directional control valves 14, 15 and the pressure sequence valve 16 are electromagnetically actuated directional control valves which are spring-loaded into a switch position. In order to actuate the directional control valves, a control device 19 is provided, the control outputs of which are connected to the control ports of the directional control valves via control lines (not shown). The control device 19 may also be referred to as a controller 19.

The hydraulic fluid is provided by a hydraulic source 20 which comprises a hydraulic tank 21 and a hydraulic pump 22, for example a gear pump. The suction port 22A of the hydraulic pump 22 is connected to the hydraulic tank 21 by a hydraulic line 23, such that the hydraulic pump can suck hydraulic fluid from the tank.

The main directional control valve 13 is an electromagnetic 4-port/3-position directional control valve which is preloaded into the central position and has an inlet port 13A for supplying hydraulic fluid from the hydraulic source 20, an outlet port 13B for discharging hydraulic fluid, a first work port 13C and a second work port 13D. In the central position shown in FIG. 4A, the inlet port 13A is blocked and the first and second work ports 13C, 13D are connected to the outlet port 13B. The main directional control valve 13 assumes the central position when no control voltage is applied to the left-hand and right-hand control ports. In the first end position, when a control voltage is applied to the left-hand control ports and the left-hand coil B of the main directional control valve is energised, the inlet port 13A is connected to the second work port 13D and the outlet port 13B is connected to the first work port 13C, and, in the second end position, when a control voltage is applied to the right-hand control ports and the right-hand coil C is energised, the inlet port 13A is connected to the first work port 13C and the outlet port 13B is connected to the second work port 13D.

The auxiliary directional control valves 14, 15 are electromagnetic 2-port/2-position directional control valves which are preloaded into one of the two switch positions and have a first work port 14A, 15A and a second work port 14B, 15B. In the first switch position into which the 2-port/2-position directional control valve is preloaded, the first work port and the second work port are blocked, and, in the second switch position, the first work port and the second work port are interconnected. When the coils D, E of the auxiliary directional control valves 14, 15 are energised, the auxiliary directional control valves switch from the first into the second switch position. The auxiliary directional control valves 14, 15 are preferably seat valves.

The pressure sequence valve 16 is an electromagnetic 2-port/2-position directional control valve having a first work port 16A and a second work port 16B which is preloaded into a first switch position in which the first and second work ports 16A, 16B are interconnected. When the coil A of the pressure sequence valve 16 is energised, the pressure sequence valve 16 switches from the first into the second switch position in which the work ports 16A, 16B are blocked. The pressure sequence valve 16 can also be omitted if the hydraulic cylinders are not supplied with hydraulic fluid by means of a hydraulic pump that has a constant flow rate, for example a gear pump, but instead by means of an adjustment pump.

The pressure port 22B of the hydraulic pump 22 is connected to the inlet port 13A of the main directional control valve 13 via an inlet hydraulic line 24, while the outlet port 13B of the main directional control valve 13 is connected to the hydraulic fluid tank 21 via an outlet hydraulic line 25. The pressure sequence valve 16 is arranged in a bypass hydraulic line 26 which connects the inlet hydraulic line 24 to the outlet hydraulic line 25. If a control voltage is not applied to the control ports of the pressure sequence valve 16 and the coil A is not energised, the pressure sequence valve 16 opens the bypass hydraulic line 26, and therefore the hydraulic fluid circulates. However, when a control voltage is applied to the control ports of the pressure sequence valve 16, the pressure sequence valve 16 closes the bypass hydraulic line 26 such that the hydraulic fluid flows to the inlet port 13A of the main directional control valve 13.

The first work port 13C of the main directional control valve 13 is connected, via hydraulic lines 27, to the first, upper hydraulic chambers 6AC and 6BC, respectively, of the first, left-hand hydraulic cylinder 6A for the left-hand edge protector 5A and of the second, right-hand hydraulic cylinder 6B for the right-hand edge protector 5B. The first, lower hydraulic chambers 6AD and 6BD, respectively, of the first, left-hand hydraulic cylinder 6A and of the second, right-hand hydraulic cylinder 6B are connected to the second work port 13D of the main directional control valve 13 via hydraulic lines 28.

When the pressure sequence valve 16 assumes the second switch position, the main directional control valve 13 is in the first switch position and the auxiliary directional control valves 14, 15 assume the second switch position, the hydraulic fluid flows into the lower hydraulic chambers 6AD, 6BD of the two hydraulic cylinders 6A, 6B, such that the left-hand and right-hand edge protectors 5A, 5B are raised. When the coil D of only the left-hand auxiliary directional control valve 6A is energised, hydraulic fluid flows only into the lower hydraulic chamber of the left-hand hydraulic cylinder 6A, such that only the left-hand edge protector 5A is raised, whereas only the right-hand edge protector 5B is raised when the coil E of only the right-hand auxiliary direction control valve 6B is energised. The hydraulic fluid can thereby flow out of the upper chamber 6AC, 6BC of the hydraulic cylinder 6A, 6B via the main directional control valve 13 into the hydraulic fluid tank 21.

In the second switch position of the main directional control valve 13, the direction of flow of the hydraulic fluid is reversed with respect to the first switch position. As a result, the hydraulic fluid flows into the upper hydraulic chambers 6AC, 6BC of the two hydraulic cylinders 6A, 6C when a control voltage is applied to the pressure sequence valve 16 and a control voltage is applied to the auxiliary directional control valves 14, 15, such that the auxiliary directional control valves assume the second switch position, as a result of which the left-hand and right-hand edge protectors 5A, 5B are lowered. When the coil D of only the left-hand auxiliary directional control valve 14 is energised, hydraulic fluid flows only into the upper hydraulic chamber 6AC of the left-hand hydraulic cylinder 6AC, such that only the left-hand edge protector 5A is lowered, whereas only the right-hand edge protector 5B is lowered when the coil E of only the right-hand auxiliary directional control valve 16 is energised. In this case, the hydraulic fluid can flow out of the lower chamber 6AD, 6BD via the relevant auxiliary directional control valve 14, 15 and the main directional control valve 13 into the hydraulic fluid tank 21.

When the main directional control valve 13 is in the third, central switch position and the auxiliary directional control valves 14, 15 assume the second switch position, a fluid connection between the first and second hydraulic chambers 6AC, 6AD of the first hydraulic cylinder 6A and a fluid connection between the first and second hydraulic chambers 6BC, 6BD of the second hydraulic cylinder 6B is established via the main directional control valve 13, such that the left-hand and right-hand edge protectors 5A, 5B are floatingly mounted. At this point in time, a control voltage is not applied to the control ports of the pressure sequence valve 16, and therefore the hydraulic fluid circulates.

If a control voltage is not applied to the control ports of the main directional control valve 13 and of the first and second auxiliary directional control valves 14, 15, the right-hand and left-hand edge protectors are locked.

FIG. 4B is a table in which the individual functions can be seen. In the table, the coil of the pressure sequence valve is denoted by the reference sign "A", the pressure sequence valve assuming the second switch position when the coil A is energised. The coils of the main directional control valve are denoted by reference signs "B" and "C", the main directional control valve 13 assuming the first switch position when coil B is energised and assuming the second switch position when coil C is energised. If neither of the two coils B and C is energised, the main flow directional control valve assumes the third, central switch position. The coil of the first auxiliary directional control valve 14 is denoted by reference sign "D" and the coil of the second auxiliary directional control valve 15 is denoted by "E". These reference signs for the coils can also be found in FIG. 4A. An arrow pointing upwards in FIG. 4B symbolizes the edge protectors 5A, 5B being raised, and an arrow pointing downwards symbolizes the edge protectors being lowered. The left-hand edge protector 5A is denoted by reference sign "L" and the right-hand edge protector 5B is denoted by "R" in FIG. 4B.

At an adjustable excess pressure, for example 200 bar, the first pressure-limiting valve 17 opens a flow path from the inlet hydraulic line 24 upstream of the inlet port 13A of the main directional control valve 13 to the outlet hydraulic line 25. At an adjustable excess pressure, for example 50 bar, hydraulic fluid can flow out of the upper chambers of the two hydraulic cylinders 6A, 6B via the second pressure-limiting valve 18. The first pressure-limiting valve 17 is used for maximum pressure protection for the entire system, and the second pressure-limiting valve 18 is used for pressure protection when lowering the edge protectors and to avoid an impermissibly high pressure on the piston rod-end of the hydraulic cylinder.

Figure 5A:
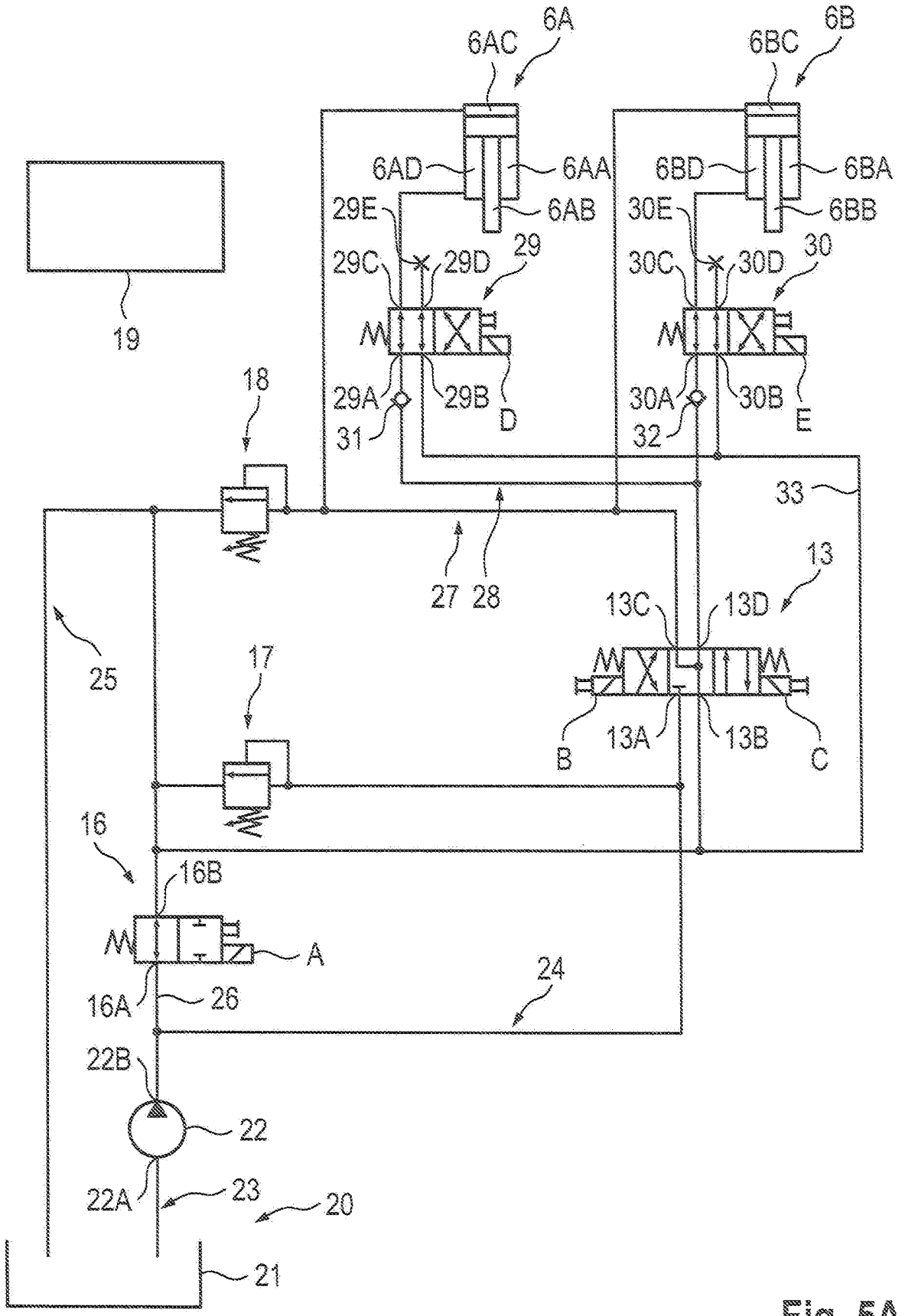
FIG. 5A shows the hydraulic circuit diagram of a second embodiment of the hydraulic system for raising and/or lowering the edge protectors of the construction machine from FIG. 1.

FIG. 5A shows a second embodiment of the hydraulic system which differs from the embodiment described with reference to FIGS. 4A and 4B on account of the first and second auxiliary directional control valves 29, 30, a first and a second non-return valve 31, 32, and an additional hydraulic line 33. Only the differences are described in the following. Corresponding parts are provided with the same reference signs in the figures.

In the second embodiment, the auxiliary directional control valves 29, 30 are 4-port/2-position directional control valves which are preloaded into one of the two switch positions and have a first work port 29A, 30A, a second work port 29B, 30B, a third work port 29C, 30C and a fourth work port 29D, 30D, the first work port and the third work port being interconnected and the second work port and the fourth work port being interconnected in the first, non-energised switch position, and the first work port being connected to the fourth work port and the second work port being connected to the third work port in the second, energised switch position. The fourth work port is closed by means of a blocked line 29E, 30E.

The first non-return valve 31 is located in one line branch and the second non-return valve 32 is located in the other line branch of the hydraulic line 33 which leads from the second work port 13D of the main directional control valve 13 to the first work ports 29A, 30A of the two auxiliary directional control valves 29, 30. The non-return valves 31, 32 are arranged in the hydraulic lines 28 such that they allow a flow of fluid through the hydraulic lines 28 from the main directional control valve 13 to the auxiliary directional control valves 29, 30 and block said flow in the opposite direction.

It is firstly assumed that the coil A of the pressure sequence valve 16 is energised, and therefore the pressure sequence valve is in the second switch position.

When the coil B of the main flow valve 13 is energised such that the main directional control valve is in the first switch position, and when the coils D and E of the auxiliary directional control valves 29, 30 are not energised such that the auxiliary valves are preloaded into the first switch position, the hydraulic fluid flows through the non-return valves 31, 32 into the lower hydraulic chambers 6AD, 6BD of the two hydraulic cylinders 6A, 6B such that the left-hand and right-hand edge protectors 5A, 5B are raised. In this case, in the first switch position of the main directional control valve 13, the hydraulic fluid can flow out of the upper chamber 6AC, 6BC of the first or second hydraulic cylinder 6A, 6B, respectively, via the main directional control valve 13 into the hydraulic fluid tank 21.

If only the coil D of the first auxiliary directional control valve 29 is energised, hydraulic fluid can only flow into the lower hydraulic chamber 6BD of the right-hand hydraulic cylinder 6B, and therefore only the right-hand edge protector 6B is raised, since the first auxiliary directional control valve 29 in the second switch position blocks the inflow to the lower hydraulic chamber 6AD of the left-hand hydraulic cylinder 6A. If only the coil E of the second auxiliary directional control valve 30 is energised, hydraulic fluid can only flow into the lower hydraulic chamber 6AD of the left-hand hydraulic cylinder 6A, and therefore only the left-hand edge protector 5A is raised, since the second auxiliary directional control valve 30 in the second switch position blocks the inflow to the lower hydraulic chamber of the right-hand hydraulic cylinder 6B.

In the second switch position of the main directional control valve 13, when the coil C is energised, the direction of flow of the hydraulic fluid is reversed with respect to the first switch position. Consequently, the hydraulic fluid flows into the upper hydraulic chambers 6AC, 6BC of the two hydraulic cylinders when a control voltage is applied to the pressure sequence valve 16, and from the lower chambers 6AD, 6BD of the two hydraulic cylinders 6A, 6B via the additional hydraulic line 33 into the hydraulic fluid tank 21 when the coils D and E of the auxiliary directional control valves 29, 30 are energised, such that the left-hand and right-hand edge protectors 5A, 6A are lowered.

If a control voltage is not applied to one of the two auxiliary directional control valves 29, 30, and therefore the relevant auxiliary directional control valve is preloaded into the first switch position, the relevant edge protector cannot be lowered, since the relevant non-return valve blocks the return flow of the hydraulic fluid from the lower hydraulic chamber of the relevant hydraulic cylinder. Thus, by applying a control voltage to the left-hand or right-hand auxiliary directional control valve 29, 30, it can be determined whether the left-hand or right-hand edge protector 5A, 5B is lowered.

When the main directional control valve 13 is in the third, central switch position and when a control voltage is applied to the auxiliary directional control valves 29, 30 such that the auxiliary directional control valves assume the second switch position, a fluid connection between the first and second hydraulic chambers 6AC, 6AD of the first hydraulic cylinder 6A and a fluid connection between the first and second hydraulic chambers 6BC, 6BD of the second hydraulic cylinder is established via the main directional control valve 13 and the additional hydraulic line 33, such that the left-hand and right-hand edge protectors 6A, 6B are floatingly mounted. At this point in time, a control voltage is not applied to the pressure sequence valve 16, and therefore the hydraulic fluid circulates.

If a control voltage is not applied to the control ports of the main directional control valve 13 and of the first and second auxiliary directional control valves 29, 30, the right-hand and left-hand edge protectors 5A, 5B are locked as in the first embodiment.

FIG. 5B shows a table in which the individual functions of the second embodiment can be seen. The same reference signs are used in FIG. 5B as in FIG. 4B.

Figure 6A:
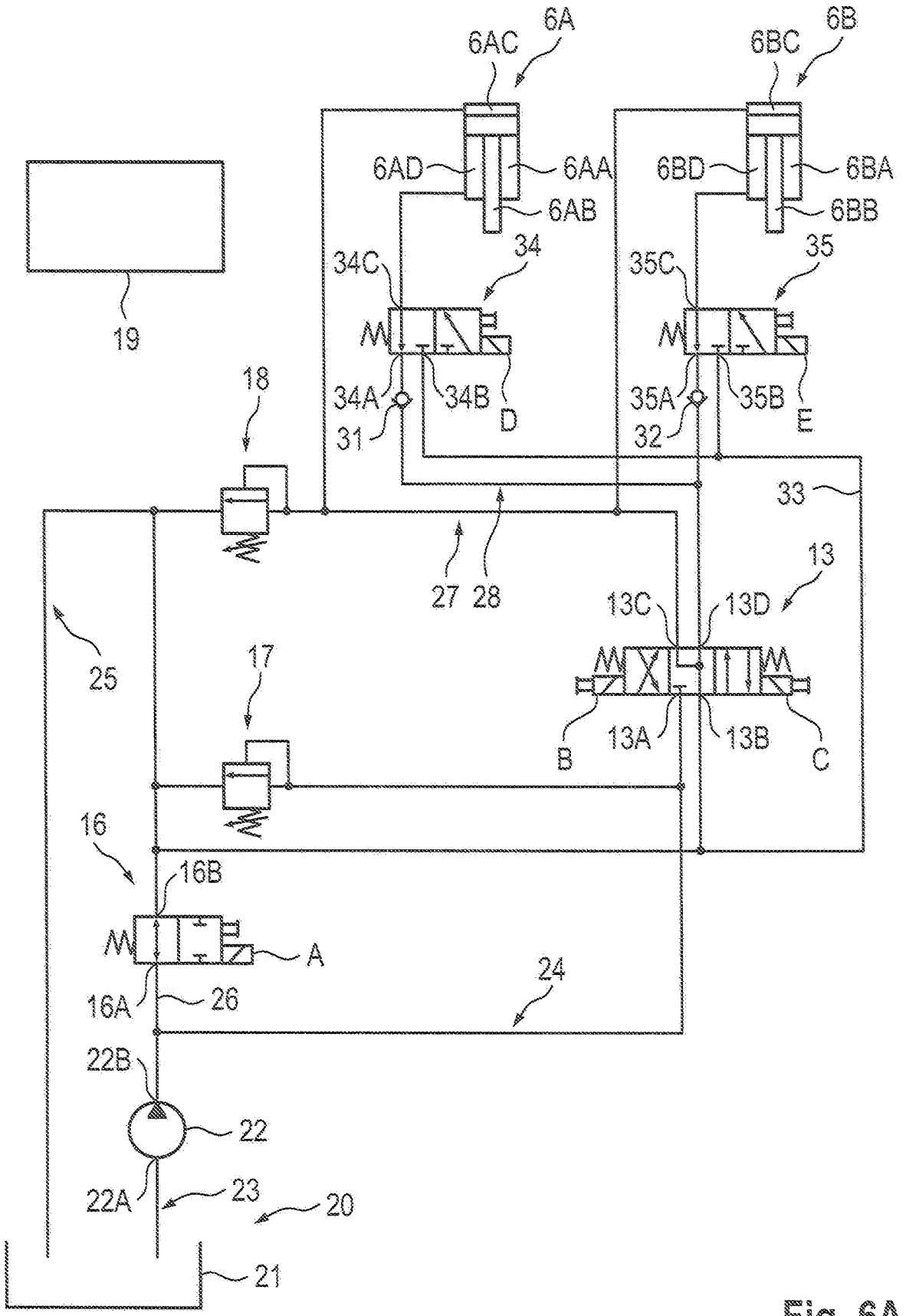
FIG. 6A shows the hydraulic circuit diagram of a third embodiment of the hydraulic system for raising and/or lowering the edge protectors of the construction machine from FIG. 1.

FIG. 6A shows a third embodiment of the hydraulic system which only differs from the embodiment described with reference to FIGS. 5A and 5B on account of the first and second auxiliary directional control valves 34, 35. Only the differences are described in the following. Corresponding parts are provided with the same reference signs in the figures.

In the third embodiment, the auxiliary directional control valves 34, 35 are 3-port/2-position directional control valves which are preloaded into one of the two switch positions and have a first work port 34A, 35A, a second work port 34B, 35B and a third work port 34C, 35C. In the first switch position, the first work port 34A, 35A and the third work port 34C, 35C are interconnected and the second work port 34B, 35B is blocked, and, in the second switch position, the first work port 34A, 35A is blocked and the second work port 34B, 35B and the third work port 34C, 35C are interconnected.

It is firstly assumed that the coil A of the pressure sequence valve 16 is energised, and therefore the pressure sequence valve 16 is in the second switch position.

When the coil B of the main flow valve 16 is energised such that the main directional control valve is in the first switch position, and when the coils D and E of the auxiliary directional control valves 34, 35 are not energised such that the auxiliary directional control valves are preloaded into the first switch position, the hydraulic fluid flows through the non-return valves 31, 32 into the lower hydraulic chambers 6AD, 6BD of the two hydraulic cylinders 6A, 6B such that the left-hand and right-hand edge protectors 5A, 5B are raised. In this case, in the first switch position of the main directional control valve 13, the hydraulic fluid can flow out of the upper chamber 6AC, 6BC of the first or second hydraulic cylinder 6A, 6B, respectively, via the main directional control valve 13 into the hydraulic fluid tank 21.

If only the coil D of the first auxiliary directional control valve 35 is energised, hydraulic fluid can only flow into the lower hydraulic chamber 6BD of the right-hand hydraulic cylinder 6B, and therefore only the right-hand edge protector 5B is raised, since the first work port 34A of the first auxiliary directional control valve 34 is blocked in the second switch position and the inflow to the lower hydraulic chamber 6AD of the left-hand hydraulic cylinder 6A is interrupted. If only the coil E of the second auxiliary directional control valve 35 is energised, hydraulic fluid can only flow into the lower hydraulic chamber 6AD of the left-hand hydraulic cylinder 6A, and therefore only the left-hand edge protector 5A is raised, since the second auxiliary directional control valve 35 in the second switch position interrupts the inflow to the lower hydraulic chamber 6BD of the right-hand hydraulic cylinder 6B.

In the second switch position of the main directional control valve 13, when the coil C is energised, the direction of flow of the hydraulic fluid is reversed. Consequently, the hydraulic fluid flows into the upper hydraulic chambers 6AC, 6BC of the two hydraulic cylinders 6A, 6B when a control voltage is applied to the pressure sequence valve 16, and the hydraulic fluid flows out of the lower chambers 6AD, 6BD of the two hydraulic cylinders 6A, 6B via the additional hydraulic line 33 into the hydraulic fluid tank 23 when the coils D, E of the auxiliary directional control valves 34, 35 are energised, such that the left-hand and right-hand edge protectors are lowered.

However, if a control voltage is not applied to one of the two auxiliary directional control valves 34, 35, and therefore the relevant auxiliary directional control valve is preloaded into the first switch position, the relevant edge protector cannot be lowered, since the relevant non-return valve 31, 32 interrupts the return flow of the hydraulic fluid from the lower hydraulic chamber of the relevant hydraulic cylinder. Thus, by applying a control voltage to the left-hand or right-hand auxiliary directional control valve 34, 35, it can be determined whether the left-hand or right-hand edge protector is lowered.

When the main directional control valve 16 is in the third, central switch position and when a control voltage is applied to the auxiliary directional control valves 34, 35 such that the auxiliary directional control valves assume the second switch position, a fluid connection between the first and second hydraulic chambers 6AC, 6AD of the first hydraulic cylinder 6A and a fluid connection between the first and second hydraulic chambers 6BC, 6BD of the second hydraulic cylinder 6B is established via the main directional control valve 13 and the additional hydraulic line 33, such that the left-hand and right-hand edge protectors 5A, 5B are floatingly mounted. At this point in time, a control voltage is not applied to the pressure sequence valve 16, and therefore the hydraulic fluid circulates.

If a control voltage is not applied to the control ports of the main directional control valve 13 and of the first and second auxiliary directional control valves 34, 35, the right-hand and left-hand edge protectors are locked as in the first embodiment.

FIG. 6B shows a table in which the individual functions of the third embodiment can be seen. The same reference signs are used again in FIG. 6B as in FIG. 4B.

The invention claimed is:

1. A self-propelled construction machine, comprising:

a machine frame;

a milling drum arranged on the machine frame;

a left-hand side-plate arranged on a left-side of the milling drum in a working direction;

a right-hand side-plate arranged on a right-side of the milling drum in the working direction;

a first double-acting hydraulic cylinder connected to the left-hand side-plate and configured to raise and lower the left-hand side-plate, the first double-acting hydraulic cylinder including two cylinder chambers;

a second double-acting hydraulic cylinder connected to the right-hand side-plate and configured to raise and lower the right-hand side-plate, the second double-acting hydraulic cylinder including two cylinder chambers;

a hydraulic system configured to raise and lower the left-hand and right-hand side-plates, the hydraulic system including:

a hydraulic source for providing hydraulic fluid;

a first auxiliary directional control valve operably associated with the first double-acting hydraulic cylinder and having two switch positions;

a second auxiliary directional control valve operably associated with the second double-acting hydraulic cylinder and having two switch positions;

one and only one main directional control valve operably associated with the first and second double-acting hydraulic cylinders and having three switch positions;

wherein in a first switch position of the main directional control valve and in one of the two switch positions of the first and second auxiliary directional control valves, the hydraulic system is configured to provide hydraulic fluid to one of the two cylinder chambers of either or both of the first and second double-acting hydraulic cylinders such that either or both of the left-hand and right-hand side-plates can be raised;

wherein in a second switch position of the main directional control valve and in one of the two switch positions of the first and second auxiliary directional control valves, the hydraulic system is configured to provide hydraulic fluid to the other of the two cylinder chambers of either or both of the first and second double-acting hydraulic cylinders such that either or both of the left-hand and right-hand side-plates can be lowered;

wherein in a third switch position of the main directional control valve and in one of the two switch positions of the first and second auxiliary directional control valves, the hydraulic system is configured to provide a fluid connection between the two cylinder chambers of the first double-acting hydraulic cylinder and a fluid connection between the two cylinder chambers of the second double-acting hydraulic cylinder such that the left-hand and right-hand side-plates are floatingly mounted.

2. The self-propelled construction machine of claim 1, wherein:

the main directional control valve is a 4-port/3-position directional control valve preloaded into the third switch position, the third switch position being a central position, the first and second switch positions being first and second end positions;

the main directional control valve includes an inlet port for supplying hydraulic fluid from the hydraulic source, an outlet port for discharging hydraulic fluid, a first work port and a second work port;

in the central position of the main directional control valve the inlet port is blocked and the first and second work ports are connected to the outlet port;

in the first end position of the main directional control valve the inlet port is connected to the second work port and the outlet port is connected to the first work port; and in the second end position of the main directional control valve the inlet port is connected to the first work port and the outlet port is connected to the second work port.

3. The self-propelled construction machine of claim 2, wherein:

the auxiliary directional control valves are 2-port/2-position directional control valves preloaded into one of the two switch positions, and each of the auxiliary directional control valves includes a first work port and a second work port;

in a first one of the two switch positions of each of the auxiliary directional control valves the first work port is blocked; and in a second one of the two switch positions of each of the auxiliary directional control valves the first work port and the second work port are interconnected.

4. The self-propelled construction machine of claim 3, wherein:

the first work port of the main directional control valve is fluidically connected to one of the two cylinder chambers of each of the first and second double-acting hydraulic cylinders;

the second work port of the main directional control valve is fluidically connected to the first work port of the first auxiliary directional control valve and to the first work port of the second auxiliary directional control valve;

the second work port of the first auxiliary directional control valve is fluidically connected to the other of the two cylinder chambers of the first double-acting hydraulic cylinder; and the second work port of the second auxiliary directional control valve is fluidically connected to the other of the two cylinder chambers of the second double-acting hydraulic cylinder.

5. The self-propelled construction machine of claim 1, wherein:

the auxiliary directional control valves are 2-port/2-position directional control valves preloaded into one of the two switch positions, and each of the auxiliary directional control valves includes a first work port and a second work port;

in a first one of the two switch positions of each of the auxiliary directional control valves the first work port is blocked; and in a second one of the two switch positions of each of the auxiliary directional control valves the first work port and the second work port are interconnected.

6. The self-propelled construction machine of claim 5, wherein:

at least one of the first and second auxiliary directional control valves is a seat valve.

7. The self-propelled construction machine of claim 1, wherein:

the auxiliary directional control valves are 4-port/2-position directional control valves preloaded into one of the two switch positions and including a first work port, a second work port, a third work port and a fourth work port;

in a first one of the two switch positions the first work port and the third work port are interconnected, and the second work port and the fourth work port are interconnected; and in a second one of the two switch positions the first work port and the fourth work port are interconnected, and the second work port and the third work port are interconnected.

8. The self-propelled construction machine of claim 7, wherein:

the main directional control valve is a 4-port/3-position directional control valve preloaded into the third switch position, the third switch position being a central position, the first and second switch positions of the main directional control valve being first and second end positions;

the main directional control valve includes an inlet port for supplying hydraulic fluid from the hydraulic source, an outlet port for discharging hydraulic fluid, a first work port and a second work port;

in the central position of the main directional control valve the inlet port is blocked and the first and second work ports of the main directional control valve are connected to the outlet port;

in the first end position of the main directional control valve the inlet port is connected to the second work port of the main directional control valve and the outlet port is connected to the first work port of the main directional control valve; and in the second end position of the main directional control valve the inlet port is connected to the first work port of the main directional control valve and the outlet port is connected to the second work port of the main directional control valve.

9. The self-propelled construction machine of claim 8, wherein:

the first work port of the main directional control valve is fluidically connected to one of the two cylinder chambers of each of the first and second double-acting hydraulic cylinders;

the second work port of the main directional control valve is fluidically connected by a first flow path to the first work port of the first auxiliary directional control valve, a first non-return valve being provided in the first flow path, the first non-return valve being open in a direction of the first auxiliary directional control valve;

the second work port of the main directional control valve is fluidically connected by a second flow path to the first work port of the second auxiliary directional control valve, a second non-return valve being provided in the second flow path, the second non-return valve being open in a direction of the second auxiliary directional control valve;

the second work port of each of the first and second auxiliary directional control valves is fluidically connected to the outlet port of the main directional control valve;

the third work port of the first auxiliary directional control valve is fluidically connected to other of the two cylinder chambers of the first double-acting hydraulic cylinder;

the third work port of the second auxiliary directional control valve is fluidically connected to the other of the two cylinder chambers of the second double-acting hydraulic cylinder; and the fourth work port of the first auxiliary directional control valve and the fourth work port of the second auxiliary directional control valve are blocked.

10. The self-propelled construction machine of claim 1, wherein:

the auxiliary directional control valves are 3-port/2-position directional control valves preloaded into one of the two switch positions and including a first work port, a second work port and a third work port;

in a first one of the two switch positions the first work port and the third work port are interconnected, and the second work port is blocked; and in a second one of the two switch positions the first work port is blocked and the second work port and the third work port are interconnected.

11. The self-propelled construction machine of claim 10, wherein:

the main directional control valve is a 4-port/3-position directional control valve preloaded into the third switch position, the third switch position being a central position, the first and second switch positions of the main directional control valve being first and second end positions;

the main directional control valve includes an inlet port for supplying hydraulic fluid from the hydraulic source, an outlet port for discharging hydraulic fluid, a first work port and a second work port;

in the central position of the main directional control valve the inlet port is blocked and the first and second work ports of the main directional control valve are connected to the outlet port;

in the first end position of the main directional control valve the inlet port is connected to the second work port of the main directional control valve and the outlet port is connected to the first work port of the main directional control valve; and in the second end position of the main directional control valve the inlet port is connected to the first work port of the main directional control valve and the outlet port is connected to the second work port of the main directional control valve.

12. The self-propelled construction machine of claim 11, wherein:

the first work port of the main directional control valve is fluidically connected to one of the two cylinder chambers of each of the first and second double-acting hydraulic cylinders;

the second work port of the main directional control valve is fluidically connected by a first flow path to the first work port of the first auxiliary directional control valve, a first non-return valve being provided in the first flow path, the first non-return valve being open in a direction of the first auxiliary directional control valve;

the second work port of the main directional control valve is fluidically connected by a second flow path to the first work port of the second auxiliary directional control valve, a second non-return valve being provided in the second flow path, the second non-return valve being open in a direction of the second auxiliary directional control valve;

the second work port of each of the first and second auxiliary directional control valves is fluidically connected to the outlet port of the main directional control valve;

the third work port of the first auxiliary directional control valve is fluidically connected to other of the two cylinder chambers of the first double-acting hydraulic cylinder; and the third work port of the second auxiliary directional control valve is fluidically connected to the other of the two cylinder chambers of the second double-acting hydraulic cylinder.

13. The self-propelled construction machine of claim 1, wherein:

the main directional control valve and the auxiliary directional control valves are electromagnetically actuated directional control valves; and the self-propelled construction machine further comprises a controller configured to actuate the main directional control valve and the auxiliary directional control valves.

14. The self-propelled construction machine of claim 1, wherein:

the hydraulic source comprises:

a hydraulic fluid tank; and a hydraulic pump having a suction port and a pressure port, the suction port being fluidically connected to the hydraulic fluid tank, and the pressure port being connected to an inlet port of the main directional control valve.

15. The self-propelled construction machine of claim 14, further comprising:

a flow path between the pressure port and the hydraulic fluid tank; and a pressure sequence valve disposed in the flow path.

16. The self-propelled construction machine of claim 15, wherein:

the pressure sequence valve is an electromagnetically actuated 2-port/2-position directional control valve including a first work port and a second work port, the pressure sequence valve being preloaded into a first switch position in which the first and second work ports are interconnected.

17. The self-propelled construction machine of claim 14, further comprising:

a flow path between the inlet port of the main directional control valve and the hydraulic fluid tank; and a pressure-limiting valve disposed in the flow path.

18. The self-propelled construction machine of claim 14, wherein:

the main directional control valve includes the inlet port for supplying hydraulic fluid from the hydraulic source, an outlet port for discharging hydraulic fluid, a first work port and a second work port;

the self-propelled construction machine further comprises:

a flow path between the first work port of the main directional control valve and the hydraulic fluid tank; and a pressure-limiting valve disposed in the flow path.

* * * * *